US007451564B2

(12) United States Patent
Wait

(10) Patent No.: US 7,451,564 B2
(45) Date of Patent: Nov. 18, 2008

(54) INTERCHANGEABLE BARREL SYSTEM FOR RIFLES

(75) Inventor: Nelson Maxwell Wait, West Palm Beach, FL (US)

(73) Assignee: Full Nelson, LLC, West Palm Beach, FL (US)

( * ) Notice: Subject to any disclaimer, the term of this patent is extended or adjusted under 35 U.S.C. 154(b) by 57 days.

(21) Appl. No.: 11/355,841

(22) Filed: Feb. 16, 2006

(65) Prior Publication Data

US 2007/0186458 A1 Aug. 16, 2007

(51) Int. Cl.
*F41A 21/00* (2006.01)

(52) U.S. Cl. ..... 42/75.02

(58) Field of Classification Search ..... 42/75.02
See application file for complete search history.

(56) References Cited

U.S. PATENT DOCUMENTS

| | | | | | |
|---|---|---|---|---|---|
| 1,580,968 | A * | 4/1926 | Di Brazza | 42/75.02 |
| 1,661,949 | A * | 3/1928 | Krenek | 42/77 |
| 2,155,498 | A * | 4/1939 | Laudensack | 42/75.01 |
| 2,345,127 | A * | 3/1944 | Schirokauer | 42/75.02 |
| 2,345,833 | A * | 4/1944 | Schirokaner | 42/75.02 |
| 3,207,036 | A * | 9/1965 | Norton | 89/191.01 |
| 3,611,611 | A * | 10/1971 | Quinney | 42/75.02 |
| 3,750,318 | A * | 8/1973 | Burris | 42/127 |
| 3,842,527 | A | 10/1974 | Low | |
| 3,883,977 | A * | 5/1975 | McClure | 42/75.02 |
| 4,429,614 | A * | 2/1984 | Tocco | 89/14.3 |
| 4,519,156 | A * | 5/1985 | Shaw | 42/77 |
| 4,596,084 | A * | 6/1986 | Martial | 42/75.03 |
| 5,410,834 | A | 5/1995 | Benton et al. | |
| 5,412,895 | A * | 5/1995 | Krieger | 42/75.02 |
| 5,501,135 | A * | 3/1996 | Beretta | 89/196 |
| 5,706,599 | A | 1/1998 | Knight | |
| 5,987,797 | A | 11/1999 | Dustin | |
| 6,293,040 | B1 | 9/2001 | Luth | |
| 6,655,372 | B1 * | 12/2003 | Field et al. | 124/83 |
| 6,959,509 | B2 * | 11/2005 | Vais | 42/75.02 |
| 2005/0188591 | A1 * | 9/2005 | Stone | 42/75.02 |
| 2006/0283318 | A1 * | 12/2006 | Beaty | 89/193 |

* cited by examiner

*Primary Examiner*—Troy Chambers
(74) *Attorney, Agent, or Firm*—McHale & Slavin, P.A.

(57) ABSTRACT

A system for use with firearms which permits the ready exchange of barrels on a single action and stock assembly. The barrels may be quickly and easily exchanged under field conditions using a single simple tool and without removing the action and receiver from the firearm stock. Barrels of different calibers may be used on a single firearm leading to greater versatility. The system relies on a pinch lug or clamp attached to the receiver which will draw all barrels onto the receiver and into invariable coaxial alignment with the receiver and action thus insuring the bullet will always have the same trajectory.

4 Claims, 4 Drawing Sheets

INTERCHANGEABLE BARREL SYSTEM FOR RIFLES

FIELD OF THE INVENTION

The field of the invention relates in general to firearms; particularly to a firearm for readily accepting a variety of interchangeable barrels having different caliber bores, and most particularly to firearms whose action receiver has been enhanced to facilitate rapid barrel interchange while ensuring zeroed accuracy.

BACKGROUND OF THE INVENTION

Many hunters and sportsmen like to pursue different game which requires ammunition of different calibers. It is inconvenient and very costly to have a different rifle or firearm for each caliber of bullet used. As a result an action and receiver for a rifle was invented which would accept ammunition of different calibers. This in turn lead to the development of interchangeable rifle barrels having different caliber bores.

Currently firearms are designed with a single action and stock that will accept a variety of different barrels, however they suffer from a number of deficiencies and impracticalities which render them generally undesirable for consumers and hunters. Among such deficiencies and impracticalities are the following.

In certain rifles with interchangeable barrels, the methods of barrel attachment unduly reduce the dimensions and weaken the barrel in the chamber area, thereby limiting the range of useable cartridges and increasing the likelihood of extraction difficulties and problems in the reloading of fired cartridges.

In other firearms with interchangeable barrels, there is a problem with consistent repeatable attachment.

Another disadvantage of methods for securing a barrel to an action in interchangeable barrel rifles is that there must be some clearance between the threads of the female action and the male barrel threads, or it will be impossible to screw the action and the barrel together. A conventional side engaging set screw will always thrust the installed barrel to the other side, opposite the set screw to some degree. This results in barrel misalignment wherein the barrel will not always be in uniform coaxial alignment with the action. Many barrel threads are three-quarters of an inch or less in length. A side deflection of only 0.001 inches in a span of 0.750 inches will produce a point of impact deflection of approximately 4.8 inches at 1000 yards. Thus producing an unsatisfactory situation from an accuracy standpoint.

DESCRIPTION OF THE PRIOR ART

U.S. Pat. No. 3,842,527 discloses a rifle with interchangeable barrels which relies upon a set screw through a receiver ring which engages the barrel threads to prevent rotation. There is a problem with this type of arrangement. Set screws, because of the nature of the work they do, are hardened to a greater degree than the metal of a rifle barrel. When the set screw repeatedly engages the softer barrel threads it will deform the threads thereby leading to difficulty in disassembling the barrel from the receiver. The above noted problem regarding repeatable accuracy as a result of the use of set screws also manifests itself herein.

Another rifle with an interchangeable barrel is U.S. Pat. No. 5,410,834. This system utilizes a receiving block onto which an interchangeable barrel is threaded. The receiving block is attached to the bolt guide assembly by inserting an alignment member of the receiving block into a channel in the bolt guide assembly and then securing them with a fastener. This arrangement does not permit accurate alignment of the barrel bore and the bolt guide. Also, each different barrel must be provided with an individual receiving block and a scope, if scopes are utilized. These duplicate parts for each different barrel substantially increase the cost of utilizing this system as well as reducing portability.

U.S. Pat. No. 5,706,599 discloses another type of interchangeable rifle barrel system in which the rifle barrel is provided with a tapered rear end portion and a shoulder. The receiver is provided with a complimentary shaped bore and an annular groove. The annular groove and the shoulder of the barrel act together to limit the penetration of the barrel into the receiver. The receiver is also provided with set screws which interact with wells provided in the tapered portion of the barrel to lock the barrel and the receiver together. This arrangement suffers from the problem that over a period of time the set screws, being harder than the barrel, will deform the metal of the barrel and not maintain the barrel and receiver in proper alignment. Also, as previously noted, the use of set screws results in problems with repeatable accuracy.

A rimfire rifle, capable of shooting multiple calibers was recently introduced by Sako, Ltd. Of Finland. Designated the Sako QUAD, this system uses a single receiver which may be coupled to four barrels. The QUAD suffers from similar problems to that of the afore-mentioned prior art in that the barrels have tapered shanks with a flat bottom. While this design insures repeatable seating of the barrel each time it is reinserted, it nevertheless requires that an Allen-head screw be provided in the bottom of the receiver. Turning the screw in raises a spring-loaded angled block that engages the flat surface on the barrel's tapered shank. This sideways pressure on the barrel is undesirable since, as outlined above, it can result in problems with repeatable accuracy.

While these firearms may be provided with interchangeable barrels they have failed to provide an interchangeable barrel which maintains coaxial alignment with the receiver, thereby ensuring zeroed accuracy barrel interchangeability, and thus providing a configuration which eliminates any problems with repeatable accuracy, and further eliminates the need for calibration with each barrel change.

SUMMARY OF THE INVENTION

The present invention is directed to a system for providing a rifle or firearm with an interchangeable barrel while maintaining repeatable accuracy of the firearm. The system is designed such that the barrel threadably attaches to the receiver. A pinch lug or pinch clamp is mounted on the receiver which acts to draw the barrel and receiver together toward a common centerline, and to a previously defined indexing point, whereby further calibration of the scope is not required after the barrels are changed. The system is designed such that only one small tool is required to change the barrels. This is a common tool so that if lost it can easily be replaced. Also, the procedure for changing the barrel is fairly simple and may be easily accomplished in the field.

Accordingly, it is an objective of the instant invention to provide a firearm with interchangeable barrels.

It is a further objective of the instant invention to provide a system for interchanging the barrels of a firearm which is accomplished with a minimum number of tools.

It is yet another objective of the instant invention to provide a system for interchanging the barrels of a firearm which may easily be employed in the field.

It is a still further objective of the invention to provide a system for interchanging the barrels of a firearm which ensures maintenance of a zeroed-accuracy condition.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

While the present invention is susceptible of embodiment in various forms, there is shown in the accompanying drawings and will hereinafter be described a presently preferred embodiment with the understanding that the present disclosure is to be considered an exemplification of the invention and is not intended to limit the invention to the specific embodiments illustrated.

The invention will now be described with reference to the following figures, where like parts are uniformly numbered throughout.

Figure 1:
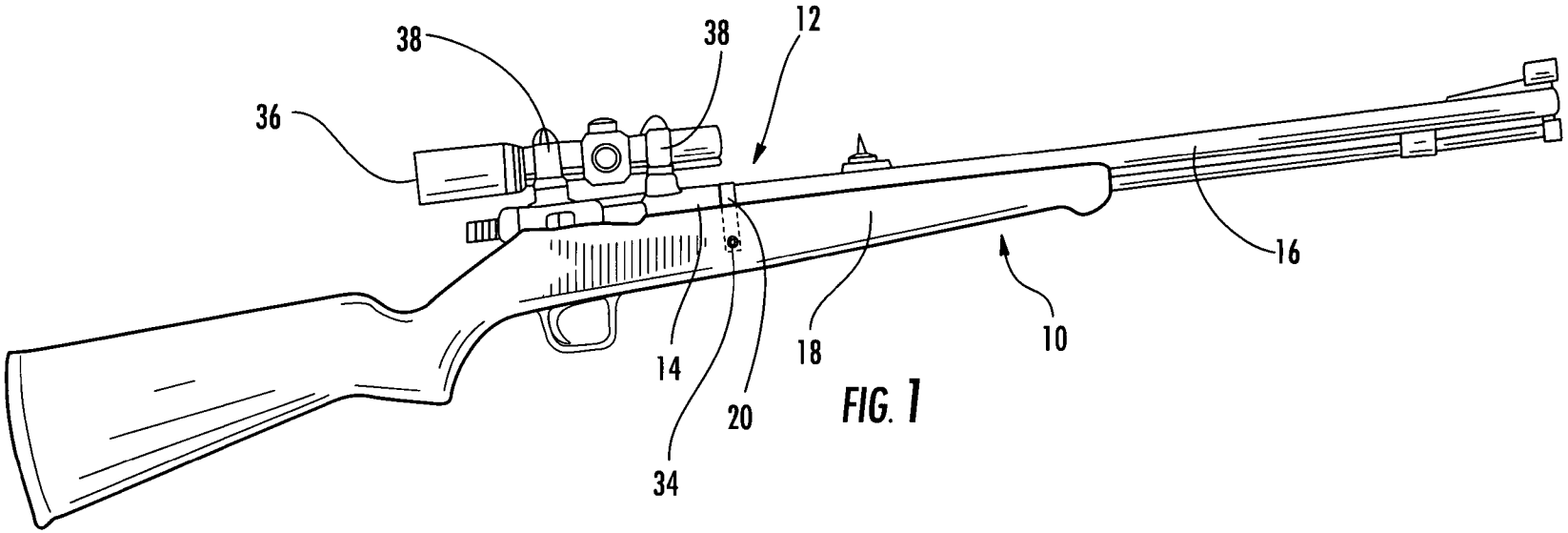
FIG. 1 is a perspective view of a rifle including the interchangeable barrel modifications in accordance with the instant invention.
Figure 2:
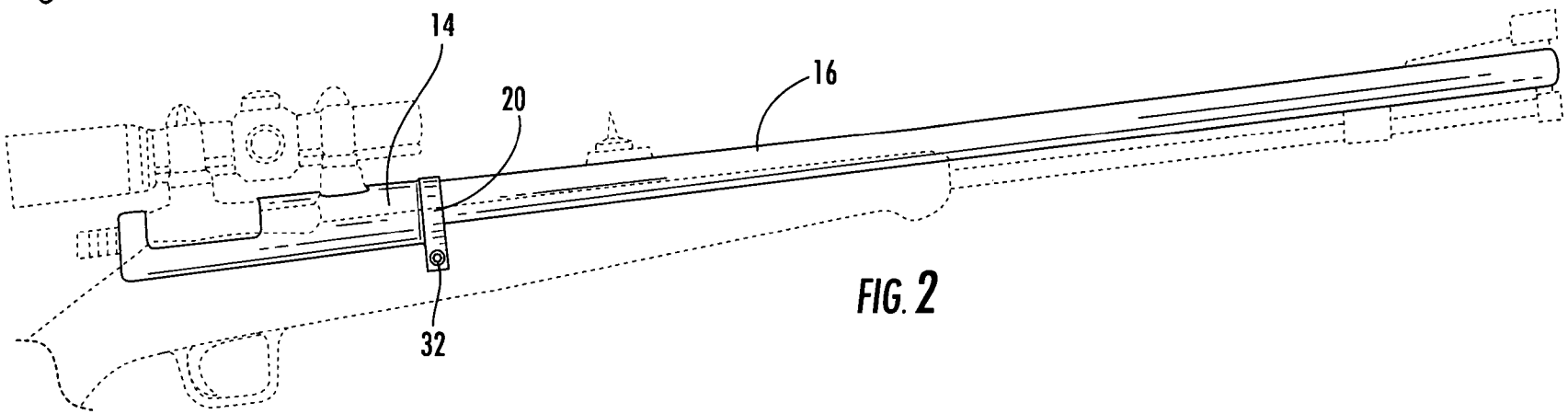
FIG. 2 is a perspective view which more particularly focuses upon the interchangeable barrel modifications in accordance with the instant invention.

Now referring to FIGS. 1 and 2, a rifle 10 is illustrated incorporating the present invention which comprises an interchangeable barrel action 12 inclusive of receiver 14, interchangeable barrel 16, and pinch lug 20. The receiver and the barrel are joined in the stock 18. In accordance with an aspect of this invention, an ACCU-LUG, which is essentially a pinch lug or pinch clamp 20 is attached to a forward end of the receiver, e.g. by welding.

Figure 3:
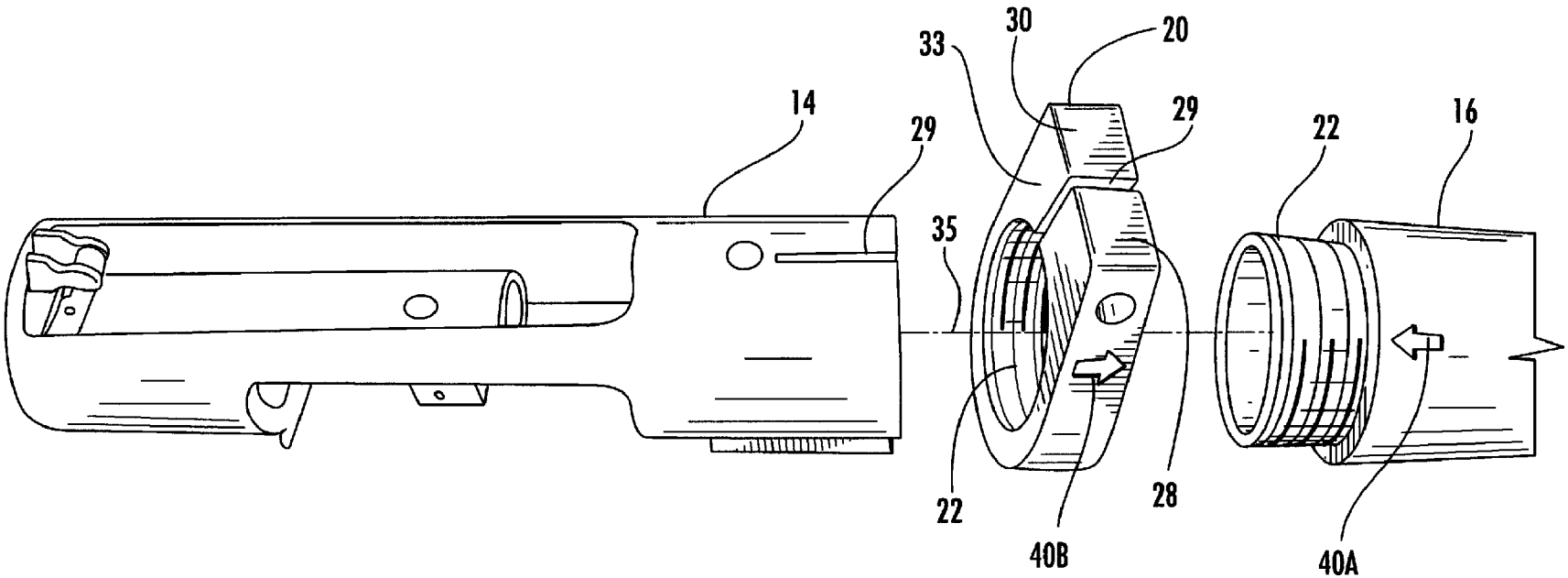
FIG. 3 is an exploded view of the receiver—ACCU-LUG—interchangeable barrel assembly in accordance with the instant invention.

For sake of clarity, it is noted that FIG. 3 represents an exploded view of an assembled rifle including the ACCU-LUG, subsequent to all welding, machining, cutting, threading, and the like.

As illustrated in exploded view FIG. 3, the pinch lug 20 and a portion of the receiver 14 (not shown) are threaded internally. An external end portion of the interchangeable barrel is also threaded. The exterior thread pattern of the barrel and the interior thread pattern of the pinch lug and the receiver are complimentary so the barrel may be readily and securely attached to the pinch lug and receiver.

The interior surface of the pinch lug and receiver are illustrated as having, but are not limited to, a series of fine pitch 60° "V" threads 22 which have a generally triangular cross-section. These threads are selected from the UNF or Fine Thread Series. This combination provides the advantage of a strong coaxial alignment between the barrel and the receiver. While the 60° UNF threads are preferred, other types of screw threads may be employed such as Acme screw threads, Centralizing Acme screw threads and Buttress threads.

The unique mechanical advantage of the 60° UNF threads is that the internal threads of the pinch lug and receiver are compressed into the external threads of the barrel such that a self centering action of the barrel results. This acts to sufficiently bind the receiver, the pinch lug and the barrel in substantially invariant coaxial alignment without the requirement of excessive torque during tightening. This provides the advantage of repeatable accuracy in firing with any given barrel.

Figure 4:
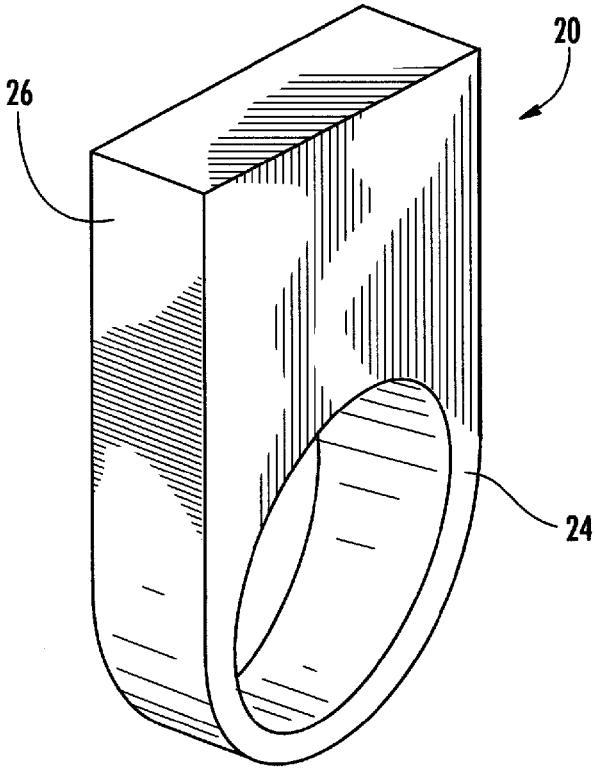
FIG. 4 is a perspective view of an ACCU-LUG prior to fixation and machining to a receiver element.
Figure 5:
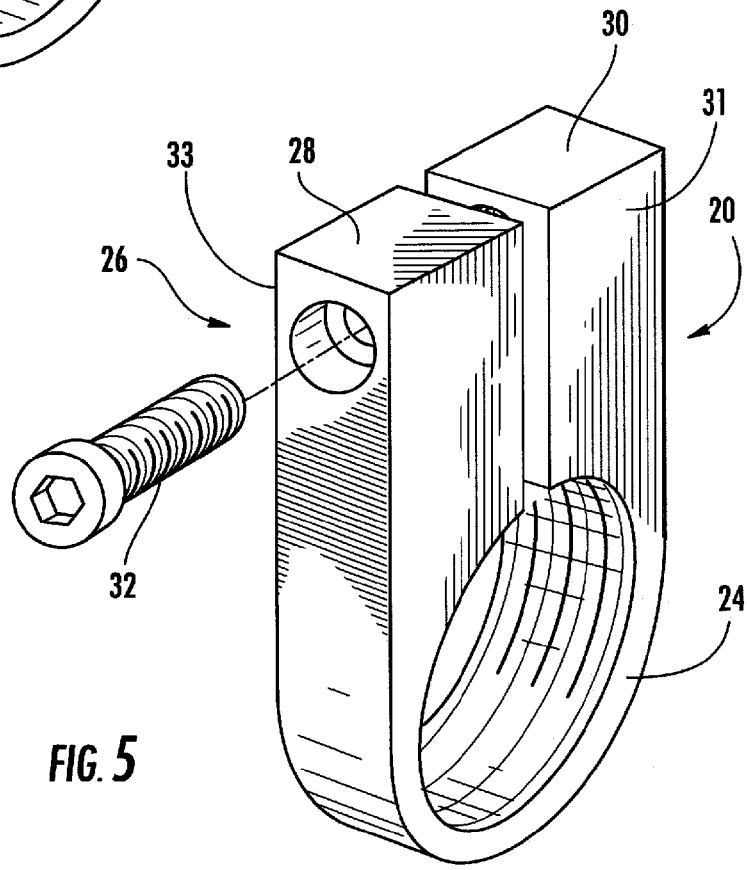
FIG. 5 is a perspective view of an ACCU-LUG including internal and external machining accomplished subsequent to fixation to a receiver.

The compression of the threads of the pinch lug and receiver into the threads of the barrel is accomplished by providing the pinch lug with a split portion and providing a split portion along a portion of the receiver. As seen in FIGS. 4 & 5, the pinch lug or pinch clamp 20 is formed with a barrel encircling portion 24 and an elongate lug portion 26. The pinch lug or clamp 20 includes a front or proximal face 31 and a rear or distal face 33. Faces 31 and 33 are parallel to each other, as seen in FIGS. 4 and 5, and transverse or perpendicular to a longitudinal axis 35 extending along the barrel and receiver of the firearm. The pinch lug is attached to one end of the receiver by any appropriate method such as welding or similar means such that it becomes integral with the receiver. Prior to attachment the pinch lug is a single piece, as particularly illustrated in FIG. 4. After attachment to the receiver the interior of the barrel encircling portion of the pinch lug and a portion of the interior of the receiver are threaded, as illustrated in FIG. 5. This prevents any misalignment between the pinch lug and the receiver so that the barrel 16 may be attached to the receiver 14, through the pinch lug 20, without encountering any break in the thread pattern and consequently no variation in the coaxial alignment of the barrel and the receiver.

Subsequent to the threading, a cut 29 is formed in the pinch lug and a portion of the receiver, as shown in FIGS. 3 & 5. The two portions of the lug 28 and 30 are connected with a standard threaded fastener 32. One of the lugs 28 is provided with an aperture which does not threadably engage the fastener and the other lug 30 is threaded to receive the threaded fastener. The head of the fastener engages the one lug 28 such that when the fastener is turned in one direction the two lugs are drawn together thereby drawing together the threaded portion of the pinch lug. This action decreases the diameter of the barrel encircling threaded portion of the pinch lug, applying uniform circumferential pressure, and avoiding the sideways pressure point of the prior art devices. As a result of this circumferential pressure, force is applied to the threads of the pinch lug which brings them into greater frictional engagement with the threads of the barrel, and is effective to maintain the barrel and pinch lug in substantially invariant coaxial alignment. When the fastener is turned in the opposite direction the two lugs are permitted to relax, wherein the threaded portion of the pinch lug increases in diameter thereby loosening its engagement with the threads of the barrel. As a result the barrel may be readily removed and another barrel with a different caliber installed in its place. The head of the fastener may be designed to receive and be turned by an allen wrench or a similar tool. The pinch lug is located in the stock of the rifle and the fastener is accessed through a hole in the stock 34 as shown in FIG. 1.

As a result of the pinch lug being integrally attached to the end of the receiver and the end of the receiver being split along part of its length, whenever the barrel encircling portion of the pinch lug expands or contracts the end portion of the receiver also expands or contracts thereby tightening or loosening its grip on the threaded barrel.

Whenever it is desired to change the barrel of the firearm the user inserts a tool into the hole 34 in the stock 18 of the firearm and loosens the fastener 32 of the pinch lug, as seen in FIG. 2. The barrel 16 is then unscrewed and removed from the receiver. A new barrel with a different caliber bore is then screwed onto the receiver. The barrels may vary in caliber from .20 to .458. The fastener of the pinch lug is then tightened and the bore of the barrel is brought into precise coaxial alignment with the receiver. If a scope 36 is employed, it is mounted on the receiver utilizing mounts 38 and does not need to be calibrated to the new barrel.

An indicator, such as an arrow 40A, is formed upon an exterior portion of the barrel 16 adjacent the end which will abut against the pinch lug 22. Another indicator, such as an arrow 40B, is formed on the exterior surface of the pinch lug 20 adjacent the end which will abut the barrel 16. When the barrel is screwed onto the receiver and the two arrows align with each other the pinch lug can be tightened and the barrel will be in precise coaxial alignment. If the arrows are in alignment and there is a space between the pinch lug and the barrel it is an indication that the barrel has not been completely screwed onto the receiver. This feature ensures zeroed accuracy for each barrel upon interchange thereof.

Figure 6:
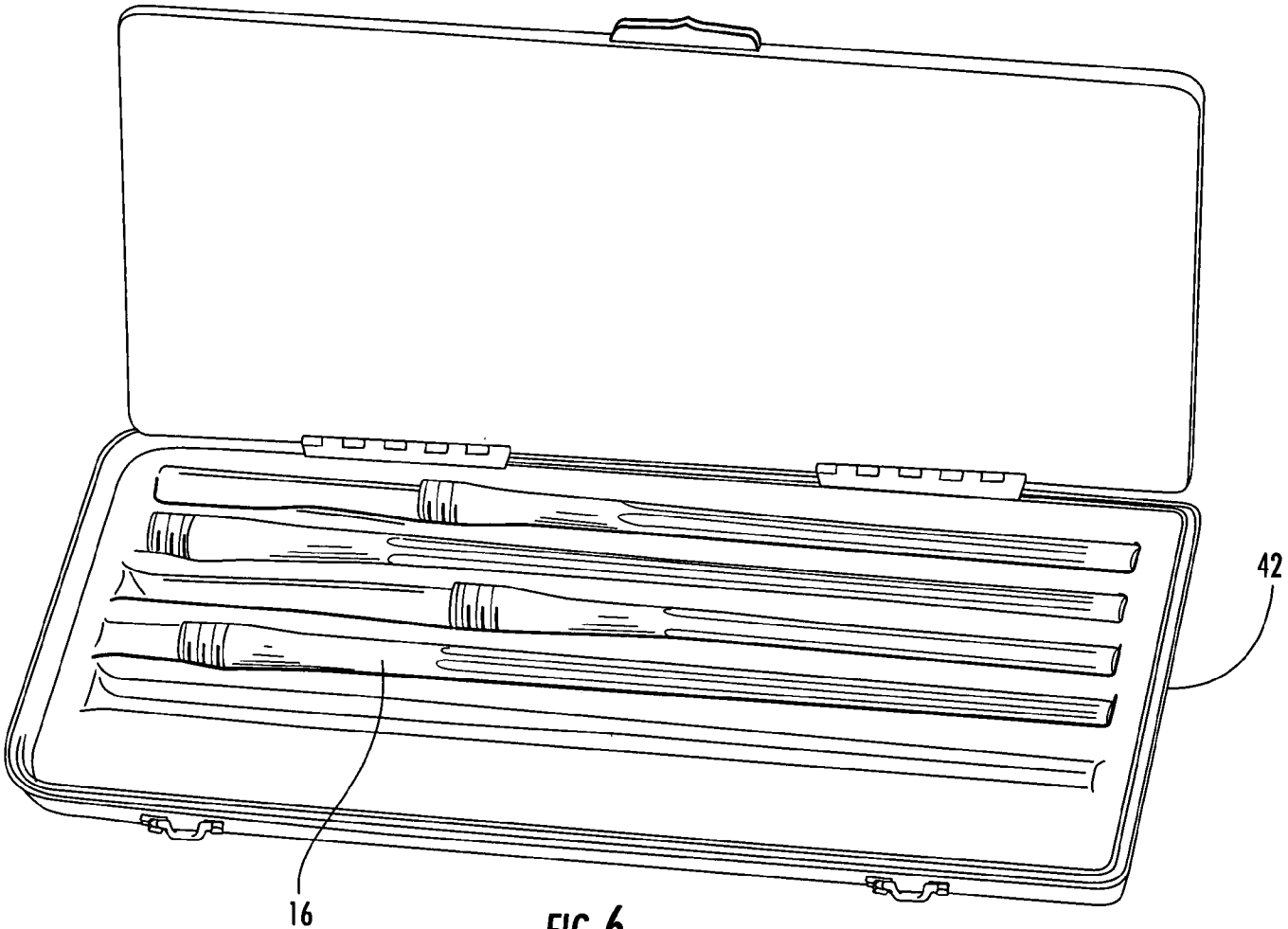
FIG. 6 is a perspective view of a plurality of interchangeable barrels within a protective enclosure.

As illustrated in FIG. 6, a case 42 may be provided for containing a plurality of interchangeable barrels 16.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A firearm system for providing zeroed accuracy interchangeability of a plurality of barrels comprising:

at least one firearm barrel having a bore aligned along a central axis and a threaded end;

a receiver in mechanical engagement with a pinch clamp, said receiver and said pinch clamp having means effective to enable repetitive threadable engagement of said firearm barrel;

wherein said engagement results in a zeroed accuracy firearm;

said pinch clamp having a proximal face and a distal face, said proximal face and said distal face are parallel to each other and transverse to a longitudinal axis of said firearm barrel;

said pinch clamp includes an elongate portion having opposing members, and a substantially circular portion, said substantially circular portion includes an interior surface, said interior surface extends from said proximal face to said distal face of said pinch clamp, said interior surface being threaded, the thread pattern of the threads of said interior surface of said pinch clamp are complementary to the thread pattern of threads on said threaded end of said firearm barrel, said threads of said interior surface of said pinch clamp circumferentially engage said threads on said end of said firearm barrel, said elongate portion includes means to provide adjustable circumferentially applied frictional engagement of said threaded end of said firearm barrel by said interior surface of said pinch clamp, said means to provide adjustable frictional engagement includes a split about which said opposing members of said elongate portion are juxtaposed; and said receiver includes a split along a portion thereof adjacent the pinch clamp and in alignment with said split in said pinch clamp.

2. The system of claim 1 wherein said elongate lower portion includes a threaded fastener constructed and arranged to provide reciprocal movement of said elongate lower portion.

3. The system of claim 1 including indicator means on said barrel and said pinch clamp to indicate when said barrel is properly indexed with respect to said pinch clamp and receiver, whereby zeroed accuracy is assured.

4. The system of claim 2 including indicator means on said barrel and said pinch clamp to indicate when said barrel is properly secured to said pinch clamp and receiver.

* * * * *